US008522988B2

(12) United States Patent
Tanaka et al.

(10) Patent No.: US 8,522,988 B2
(45) Date of Patent: Sep. 3, 2013

(54) JIB STOWING DEVICE FOR JIB CRANE VEHICLE

(75) Inventors: Kenji Tanaka, Takamatsu (JP); Kazuhiro Kobayashi, Takamatsu (JP); Toshiaki Arakawa, Takamatsu (JP)

(73) Assignee: Tadano Co., Ltd., Kagawa (JP)

( * ) Notice: Subject to any disclaimer, the term of this patent is extended or adjusted under 35 U.S.C. 154(b) by 263 days.

(21) Appl. No.: 13/060,394

(22) PCT Filed: Aug. 18, 2009

(86) PCT No.: PCT/JP2009/064439

§ 371 (c)(1),
(2), (4) Date: Feb. 23, 2011

(87) PCT Pub. No.: WO2010/024151

PCT Pub. Date: Mar. 4, 2010

(65) Prior Publication Data

US 2011/0147331 A1 Jun. 23, 2011

(30) Foreign Application Priority Data

Aug. 29, 2008 (JP) ..... 2008-220907

(51) Int. Cl.
*B66C 23/42* (2006.01)

(52) U.S. Cl.
USPC ..... 212/300; 212/299

(58) Field of Classification Search
USPC ..... 212/294, 299, 300, 347, 348, 271
IPC ..... B66C 23/70
See application file for complete search history.

(56) References Cited

U.S. PATENT DOCUMENTS

| | | | | | |
|---|---|---|---|---|---|
| 3,831,771 | A * | 8/1974 | Wiencek | 212/300 |
| 4,141,455 | A * | 2/1979 | Henderson et al. | 212/300 |
| 4,621,742 | A * | 11/1986 | Rathi | 212/177 |
| 4,828,124 | A * | 5/1989 | Iga | 212/300 |
| 5,111,945 | A * | 5/1992 | Hull et al. | 212/168 |
| 5,193,698 | A * | 3/1993 | Koizumi | 212/168 |
| 5,673,805 | A * | 10/1997 | Chaffin | 212/347 |
| 6,036,035 | A * | 3/2000 | Asano et al. | 212/300 |
| 6,655,539 | B2 * | 12/2003 | Bertinotti | 212/300 |
| 2004/0104192 | A1 * | 6/2004 | Stowasser et al. | 212/348 |

FOREIGN PATENT DOCUMENTS

| | | |
|---|---|---|
| JP | Y-S56-2715 | 1/1981 |
| JP | 09-151079 | 6/1997 |
| JP | 2003-226486 | 8/2003 |

* cited by examiner

*Primary Examiner* — Michael Mansen
*Assistant Examiner* — Angela Caligiuri
(74) *Attorney, Agent, or Firm* — Bacon & Thomas, PLLC

(57) ABSTRACT

The danger of a jib falling off a boom due to an erroneous operation during movement of the jib between a stowage position and an extended position is eliminated. The jib is provided with a pivot pin insertion state detector, pivot pin retraction blocking element, a coupling pin insertion state detector, first and second cables, wherein movement of a coupling pin to a retracted position is restricted by a coupling pin retraction blocking element via the first cable when the pivot pin insertion state detector has detected that the pivot pin is retracted, and movement of the pivot pin to the retracted is restricted by the pivot pin retraction blocking element via the second cable when the coupling pin insertion state detector has detected that the coupling pin is retracted, so that simultaneous removal of both of the pivot pin and the coupling pin is prevented.

3 Claims, 15 Drawing Sheets

JIB STOWING DEVICE FOR JIB CRANE VEHICLE

TECHNICAL FIELD

The present invention relates to a jib stowing device for a jib crane vehicle.

BACKGROUND ART

On a jib crane vehicle, a jib is extended forward from a distal portion of a top boom of a telescopic boom when the jib is used, and the jib is stowed on one side of a base boom of the telescopic boom when the jib is not used.

In a jib crane vehicle of this type, the operations to extend and stow the jib are performed as described below.

First, in a jib stowage position, a boss (with a pin hole) on a distal portion of the top boom and a boss (with a pin hole) on a proximal portion of the jib are uncoupled, and the jib is supported in a position extending along one side of the base boom by first stowing means located on the distal side on the base boom and second stowing means located on the proximal side on the base boom. To bring the jib from the stowage position to the extended position, the telescopic boom is fully contracted and the second stowing means on the proximal side on the base boom is uncoupled. Then, bosses on a first side portion of the top boom distal portion and bosses on a first side portion of the jib proximal portion are aligned with each other and these bosses are coupled to each other by a common pivot pin. Next, the first stowing means on the distal side on the base boom is uncoupled and the jib is rotated to the front of the top boom distal portion about the pivot pin. Then, bosses (with a pin hole) on a second side portion of the top boom distal portion and bosses (with a pin hole) on a second side portion of the jib proximal portion are aligned with each other and the bosses are coupled to each other by a coupling pin.

When the jib is brought from the stowage position to the extended position, the telescopic boom is fully contracted and the coupling pin on the non-pivot side between the top boom distal portion and the jib proximal portion is pulled out. Then, the jib is rotated into a space on one side of the telescopic boom about the pivot pin coupling the bosses on the first side portion of the top boom distal portion and the bosses on the first side portion of the jib proximal portion until the jib lies along a lateral side of the base boom, and a lateral side of the jib is coupled to the lateral side of the base boom by the first stowing means located on the distal side on the base boom. Then, the pivot pin that couples the top boom distal portion and the jib proximal portion is pulled out, and a distal portion of the jib is coupled to a proximal portion of the base boom by the second stowing means located on the proximal side on the base boom.

When the jib is extended to the front of the top boom distal portion from the stowage position, it is very dangerous to uncouple the first stowing means by mistake when the bosses on the top boom distal portion and the bosses on the jib proximal portion are not coupled with each other by the pivot pin, because there is a possibility of the jib falling off. Especially, when the first stowing means is configured to be manually operated from below the jib, the possibility of the jib falling off could lead to a physical injury.

Therefore, the applicant of the present invention has proposed a jib stowing device in which the first stowing means cannot be uncoupled unless the boss on the top boom distal portion and the boss on the jib proximal portion are coupled by the pivot pin (JP-A-2003-226486 as Patent Document 1).

The jib stowing device of Patent Document 1, which is shown in FIG. 12 to FIG. 15, is constituted as described below.

The jib stowing device of the related art (Patent Document 1) includes bosses (14*a* and 14*b*) with a pin hole provided on a first side portion of a distal portion 13 of a top boom 12 of a telescopic boom 1 and bosses (24*a* and 24*b*) with a pin hole provided on a first side portion of a proximal portion 23 (jib support) of a jib 2 which are removably couplable to each other by means of a pivot pin 30 (upper pivot pin 31 and a lower pivot pin 32), and first stowing means A provided between a distal position on a lateral side of a base boom 11 of the telescopic boom 1 and a proximal position of a lateral side of the jib 2 as shown in FIG. 12 to FIG. 13. Second stowing means (not shown) for coupling a distal portion of the jib to the base boom is provided between a distal lateral side of the jib 2 and a proximal lateral side of the base boom 11.

The bosses (14*a* and 14*b*) on the top boom distal portion 13 and the bosses (24*a* and 24*b*) on the jib proximal portion 23 are provided at two locations vertically separated from each other as shown in FIG. 13. That is, the bosses on the top boom distal portion 13 includes an upper boss 14*a* and a lower boss 14*b* (one each), and the bosses on the jib proximal portion 23 includes upper bosses 24*a* and lower bosses 24*b* (two each).

The pivot pin 30 includes a threaded rod 33, and an upper pivot pin 31 and a lower pivot pin 32, each of which is formed of a female-threaded cylinder, threaded over upper and lower portions, respectively, of the threaded rod 33 as shown in FIG. 13. Threads running in the opposite directions are formed on the upper and lower halves of the threaded rod 33, and the upper pivot pin 31 and the lower pivot pin 32 are threaded on the oppositely threaded portions. Therefore, by rotating a lower end of the threaded rod 33 to the right or left with a rotary tool, the upper and lower pivot pins 31 and 32 can be moved toward (in a pin retracting direction) or away from (in a pin inserting direction) each other.

The pivot pin 30 is located between the upper and lower bosses 24*a* and 24*b* on the jib proximal portion 23. In the jib stowage state, the upper pivot pin 31 and the lower pivot pin 32 are retracted out of the upper boss 14*a* and the lower boss 14*b*, respectively, on the top boom distal portion 13 (the coupling between the top boom distal portion 13 and the jib proximal portion 23 is released) when the upper and lower pivot pins 31 and 32 are operated in a direction toward each other, and the upper pivot pin 31 and the lower pivot pin 32 are inserted into the upper boss 14*a* and the lower boss 14*b*, respectively, on the top boom distal portion 13 (the top boom distal portion 13 and the jib proximal portion 23 are coupled to each other) when the upper and lower pivot pins 31 and 32 are operated in a direction away from each other.

As shown in FIG. 13, the first stowing means A has upper bosses (with a pin hole) 17*a* and lower bosses (with a pin hole) 17*b* provided at two vertically separated locations on a lateral side of the base boom 11 (FIG. 12), an upper boss (with a pin hole) 27*a* and a lower boss (with a pin hole) 27*b* provided at two vertically separated locations on a lateral side of the jib 2, upper and lower coupling pins 41 and 42 for coupling and uncoupling the upper and lower bosses (17*a* and 27*a*, and 17*b* and 27*b*), and a hydraulic cylinder 45 for moving the upper and lower coupling pins 41 and 42 toward and away from each other. The hydraulic cylinder 45 is disposed with its tube 46 located above its rod 47. The upper coupling pin 41 is connected to the upper end of the tube 46, and the lower coupling pin 42 is connected to the lower end of the rod 47. The hydraulic cylinder 45 and the upper and lower coupling pins 41 and 42 are attached to the base boom 11.

When the jib 2 is laid along the base boom 11 as shown in FIG. 12, the upper bosses 17*a* on the base boom 11 and the upper boss 27*a* on the jib 2, and the lower bosses 17*b* on the base boom 11 and the lower boss 27*b* on the jib 2 are aligned with each other as shown in FIG. 13. When the hydraulic cylinder 45 is extended with the upper and lower bosses aligned with each other, the upper coupling pin 41 is inserted into the upper bosses 17*a* and 27*a* and the lower coupling pin 42 is inserted into the lower bosses 17*b* and 27*b* (the first stowing means A is brought into a coupled state). On the other hand, when the hydraulic cylinder 45 is contracted from the state where the upper and lower coupling pins 41 and 42 couple the upper and lower bosses, respectively, the upper and lower coupling pins 41 and 42 are retracted out of the upper and lower bosses 27*a* and 27*b* on the jib and the first stowing means A is brought into an uncoupled state.

In addition, the jib stowing device of the related art is provided with pivot pin insertion state detecting means 5 for detecting whether or not the upper and lower pivot pins 31 and 32 are inserted in the upper and lower bosses 14*a* and 14*b*, respectively, on the top boom distal portion 13, coupling pin retraction restricting means 8 for restricting the upper and lower coupling pins 41 and 42 of the first stowing means A from being retracted out of the upper and lower bosses 27*a* and 27*b* on the jib 2, and associating means (control cable) 91 for associating the pivot pin insertion state detecting means 5 and the coupling pin retraction restricting means 8 as shown in FIG. 13 and FIG. 14.

The control cable 91 as the associating means has an outer casing 92 and an inner cable 93 movably received in the outer casing 92.

As the pivot pin insertion state detecting means 5, a protrusion 51 secured to the upper pivot pin 31 is employed. The protrusion 51 can move vertically in accordance with vertical movement of the upper pivot pin 31 to detect the insertion state of the upper and lower pivot pins 31 and 32. In the related art, because the upper and lower pivot pins 31 and 32 are simultaneously moved toward or away from each other by the threaded rod 33, the insertion state of both the pivot pins 31 and 32 can be detected by detecting vertical movement of one of the pivot pins (upper pivot pin 31).

A first end 93*a* of the inner cable 93 of the control cable 91 is coupled to the protrusion 51 as the pivot pin insertion state detecting means 5, and the inner cable 93 is pushed or pulled relative to the outer casing 92 when the protrusion 51 moves vertically.

The coupling pin retraction restricting means 8 has a restricting member 81 which can retractably enter a gap S between the lower end of the tube 46 of the hydraulic cylinder 45 and the upper end of the lower coupling pin 42 as shown in FIG. 13 and FIG. 14. The restricting member 81 has a vertical length which is slightly smaller than the width of the gap S between the lower end of the cylinder tube 46 and the upper end of the lower coupling pin 42 at the time when the hydraulic cylinder 45 has been extended. Also, the restricting member 81 is swingably pivoted by a shaft 82 on a mounting base 26 attached to the jib 2 at the first stowing means A. The restricting member 81 is urged in a restricting direction (direction toward the cylinder rod 47) as indicated by solid lines in FIG. 14 by a spring 85 (FIG. 14). In addition, a second end 93*b* of the inner cable 93 of the control cable 91 is coupled to the restricting member 81, and the restricting member 81 is displaced to a non-restricting position (reference numeral 81) indicated by dotted lines in FIG. 14 against the urging force of the spring 85 when the inner cable 93 is pulled as a result of vertical movement of the protrusion 51.

The jib stowing device of the related art shown in FIG. 12 to FIG. 14 functions as shown in FIGS. 15(A) and (B).

First, when the upper and lower pivot pins 31 and 32 are not inserted in the upper and lower bosses 14*a* and 14*b* on the top boom distal portion 13 (the pivot pin 30 is in a contracted state), the restricting member 81 is positioned in the gap S between the lower end of the cylinder tube 46 and the upper end of the lower coupling pin 42 by the urging force of the spring 85 as shown in FIG. 15(A) because the protrusion 51 is located at its lowered position and the pulling effect of the control cable 91 (inner cable 93) does not act on the restricting member 81. In the state shown in FIG. 15(A), because the restricting member 81 is positioned in the gap S, the restricting member 81 in the gap S prevents the hydraulic cylinder 45 from contracting even if the hydraulic cylinder 45 is operated to the contraction side. As a result, the upper and lower coupling pins 41 and 42 are not retracted out of the upper and lower bosses 17*a* and 17*b* on the jib 2 (the coupled state of the first stowing means A is maintained).

On the other hand, when the upper and lower pivot pins 31 and 32 are inserted in the upper and lower bosses 14*a* and 14*b* on the top boom distal portion 13 (the pivot pin 30 is in an extended state) as shown in FIG. 15(B), the pulling effect of the control cable 91 (inner cable 93) acts on the restricting member 81 because the protrusion 51 is located in its raised position, and the restricting member 81 is positioned outside the gap S between the lower end of the cylinder tube 46 and the upper end of the lower coupling pin 42 against the urging force of the spring 85 (the state indicated by reference numeral 81' in FIG. 14). In the state shown in FIG. 15(B), the hydraulic cylinder 45 can be contracted, and the upper and lower coupling pins 41 and 42 can be retracted out of the upper and lower bosses 27*a* and 27*b* on the jib 2 by contracting the hydraulic cylinder 45.

In the jib stowing device according to the related art constituted as described above (FIG. 12 to FIG. 15), when the jib 2 is extended forward from the stowed state along the base boom 11 (the state shown in FIG. 15(A)), the upper and lower coupling pins 41 and 42 of the first stowing means A are retracted out of the upper and lower bosses 27*a* and 27*b* on the jib 2 after the upper and lower pivot pins 31 and 32 have been inserted into the upper and lower bosses 14*a* and 14*b* on the top boom distal portion 13 as shown in FIG. 15(B). At this time, even if the upper and lower coupling pins 41 and 42 of the first stowing means A are retracted (the hydraulic cylinder 45 is contracted) by mistake with the upper and lower pivot pins 31 and 32 in the retracted state, the upper and lower coupling pins 41 and 42 cannot be retracted (pulled out) because the restricting member 81 is in the restricting position.

Therefore, the jib stowing device of the related art has a function of preventing the pivot pins (31 and 32) and the coupling pins (41 and 42) from being retracted (pulled out) simultaneously during a jib extending operation to secure safety during a jib extend operation.

Patent Document 1: JP Patent Application Publication No. 2003-226486

DISCLOSURE OF THE INVENTION

Problem to be Solved by the Invention

The jib stowing device of the related art discussed above (FIG. 12 to FIG. 15) can secure safety against an erroneous operation when the jib is extended from a stowed state, but each of the above means (the pivot pin insertion state detecting means 5, the coupling pin retraction restricting means 8, the associating means 91 and so on) are not effective at all for safety when the jib is stowed from an extended state.

In other words, when the jib is stowed from an extended state, the jib 2 is rotated to a position where it extends along a lateral side of the base boom 11 with the upper and lower pivot pins 31 and 32 inserted in the upper and lower bosses 14*a* and 14*b* on the top boom distal portion 13. Then, the upper and lower coupling pins 41 and 42 of the first stowing means A are inserted into the upper and lower bosses 27*a* and 27*b* on the jib 2, and the upper and lower pivot pins 31 and 32 are retracted out of the upper and lower bosses 14*a* and 14*b* on the top boom distal portion 13. At this time, the upper and lower pivot pins 31 and 32 could be pulled out by mistake even if the upper and lower coupling pins 41 and 42 of the first stowing means A are not inserted. In this case, the jib 2 may fall off the telescopic boom 1.

It is, therefore, an object of the present invention to provide a jib stowing device for a jib crane vehicle which can eliminate the risk of the jib falling off due to an erroneous operation both during an operation to extend the jib to the front of a top boom distal portion from a stowage position on one side of the base boom and during an operation to stow the jib from the forward extended position to one side of the base boom.

Means for Solving the Problem

As means for solving the above problem, the present invention has the following configuration. The present invention is directed to a jib stowing device for a jib crane vehicle.

The jib crane vehicle according to the present invention is provided with a jib removably attachable to a distal portion of a top boom of a telescopic boom mounted on a vehicle. The telescopic boom is attached to a rotating platform mounted on the vehicle for arcuate movement.

A jib stowing device for a jib crane vehicle according to the present invention comprises a common pivot pin retractably insertable into a boss (with a pin hole) provided on a first side portion of the distal portion of the top boom and a boss (with a pin hole) provided on a first side portion of a proximal portion of the jib when the bosses are aligned with each other so that the jib can be rotated about the pivot pin in a space on one side of the telescopic boom with the telescopic boom in a fully contracted state between an extended position in which the jib is extended to the front of the distal portion of the top boom and a stowage position in which the jib is located along one side of a base boom of the telescopic boom, and stowing means provided between the base boom and the jib for stowing the jib on a lateral side of the base boom.

In the following description, the term "insertion" of a pivot pin or coupling pin is intended to refer to coupling between a boss on the boom and a boss on the jib with the pin, and the term "retraction" of the pivot pin or coupling pin is intended to refer to "uncoupling" of the boss on the boom from the boss on the jib.

While the stowing means disposed between the base boom and the jib preferably include first stowing means located on the distal side on the base boom and second stowing means located on the proximal side on the base boom as in the related art discussed above so that the jib can be supported at two points, only one stowing means may be provided generally at the center of the base boom (in the vicinity of the center of gravity of the jib).

The stowing means has a boss (with a pin hole) provided on the lateral side of the base boom, a boss (with a pin hole) provided on a lateral side of the jib, and a coupling pin removably insertable into the bosses.

On the jib, there are provided pivot pin insertion state detecting means for mechanically detecting whether or not the pivot pin is in an inserted position, pivot pin retraction restricting means for mechanically restricting movement of the pivot pin to a retracted side, coupling pin insertion state detecting means for mechanically detecting whether or not the coupling pin is in an inserted position, coupling pin retraction restricting means for mechanically restricting movement of the coupling pin to a retracted side, first associating means for mechanically associating the pivot pin insertion state detecting means and the coupling pin retraction restricting means, and second associating means for mechanically associating the coupling pin insertion state detecting means and the pivot pin retraction restricting means.

In the jib stowing device according to the present invention, movement of the coupling pin to the retracted side is restricted by the coupling pin retraction restricting means via the first associating means when the pivot pin insertion state detecting means has detected a retracted state of the pivot pin, and the restriction of movement of the coupling pin to the retracted side by the coupling pin retraction restricting means via the first associating means is released when the pivot pin insertion state detecting means has detected an inserted state of the pivot pin, while movement of the pivot pin to the retracted side is restricted by the pivot pin retraction restricting means via the second associating means when the coupling pin insertion state detecting means has detected a retracted state of the coupling pin, and the restriction of movement of the pivot pin to the retracted side by the pivot pin retraction restricting means via the second associating means is released when the coupling pin insertion state detecting means has detected an inserted state of the coupling pin.

The jib stowing device according to the present invention has the following effects.

First, when the jib is extended from the stowed state on one side of the base boom, the coupling pin of the stowing means is retracted after the pivot pin has been inserted into the boss on a first side portion of the top boom distal portion and the boss on a first side portion of the jib proximal portion. At this time, the pivot pin insertion state detecting means, the coupling pin retraction restricting means and the first associating means prevent the coupling pin of the stowing means from being retracted if the pivot pin is in a retracted state. Thus, even if the coupling pin of the stowing means is retracted by mistake with the pivot pin in a retracted state (uncoupled state), the coupling pin cannot be retracted (a coupled state provided by the coupling pin is maintained). Therefore, both the pivot pin and the coupling pin cannot be (simultaneously) retracted during a jib extending operation even if there is an erroneous operation (misconception).

When the jib is stowed to one side of the base boom from the extended state in front of the top boom distal portion, the pivot pin is retracted after the jib has been rotated about the pivot pin to one side of the base boom and the coupling pin has been inserted into the stowing means. At this time, the coupling pin insertion state detecting means, the pivot pin retraction restricting means and the second associating means prevent the pivot pin from being retracted if the coupling pin is in a retracted state. Thus, even if the pivot pin is retracted by mistake with the coupling pin in a retracted state (uncoupled state), the pivot pin cannot be retracted, (a coupled state provided by the pivot pin is maintained). Therefore, both the pivot pin and the coupling pin cannot be (simultaneously) retracted during a jib stowing operation even if there is an erroneous operation (misconception).

Also, the pivot pin insertion state detecting means, the coupling pin insertion state detecting means, the pivot pin retraction restricting means, the coupling pin retraction restricting means, the first associating means, and the second associating means used in the jib stowing device according to the present invention are collectively provided on the jib. Therefore, each of the means does not interfere with the extension and contraction of the boom even when a crane operation (extension and contraction of the boom) is performed only with the telescopic boom in the jib stowage state (state in which the jib is separate from the top boom). In addition, because each of the above means is mechanically installed, there is no need to provide a connector for power source connection (requiring connecting and disconnecting operations) between the telescopic boom and the jib or provide a control controller in contrast to means which operates on electricity or hydraulic pressure.

In the jib stowing device according to the present invention, wherein the coupling pin of the stowing means is provided on the base boom. The coupling pin insertion state detecting means on the jib is removably engageable with the coupling pin. Thus, the coupling pin insertion state detecting means is engaged with the coupling pin when the jib is stowed on one side of the base boom so that the coupling pin insertion state detecting means can detect an insertion state of the coupling pin.

When the coupling pin of the stowing means is inserted and extracted by a hydraulic cylinder, for example, as in a related art shown in FIG. 12 to FIG. 15, the hydraulic cylinder and the coupling pin must be provided on the base boom because the hydraulic cylinder for moving the coupling pin needs to be connected to a hydraulic source. When the coupling pin is provided on the base boom and the coupling pin insertion state detecting means is provided on the jib, the coupling pin and the coupling pin insertion state detecting means need to be removably engageable with each other because the jib is displaced between a stowage position and a separate position relative to the base boom.

Therefore, in the jib stowing device according to the present invention, coupling pin insertion state detecting means which is removably engageable with the coupling pin is used so that the insertion state of the coupling pin can be detected when the coupling pin is provided on the base boom.

Effect of the Invention

The jib stowing device according to the present invention has the following effects.

According the present invention, both when the jib is extended from the stowed state and when the jib is stowed from the extended state, even if either the pivot pin 30 or the coupling pin undergoes a retracting operation by mistake, the operated pin is not retracted (pulled out) if the other of the pivot pin or the coupling pin is in the retracted state (uncoupled state). Thus, a trouble of both the pivot pin and the coupling pin being pulled out by an erroneous operation can be prevented from occurring both during a jib stowing operation and during a jib extending operation. Therefore, the effect is obtained that safety can be secured both when the jib is stowed and when the jib is extended (the possibility of the jib falling off is eliminated).

Also, the pivot pin insertion state detecting means, the coupling pin insertion state detecting means, the pivot pin retraction restricting means, the coupling pin retraction restricting means, the first associating means, and the second associating means are collectively provided on the jib. Therefore, the effect is obtained that each of the means does not interfere with the extension and contraction of the boom even when a crane operation (extension and contraction of the boom) is performed only with the telescopic boom in the jib stowage state (state in which the jib is separate from the top boom).

In addition, because each of the above means is mechanically installed, there is no need to provide a connector for power source connection (requiring connecting and disconnecting operations) between the telescopic boom and the jib or to provide a control controller. Therefore, the effect is obtained that the safety during stowage and extension of the jib can be secured with a simple configuration in contrast to means which operates on electricity or hydraulic pressure.

In the invention, the coupling pin insertion state detecting means is removably engageable with the coupling pin so that the insertion state of the coupling pin can be detected by the coupling pin insertion state detecting means in a jib stowage state even when the coupling pin of the stowing means is provided on the base boom and the insertion state of the coupling pin is detected by coupling pin insertion state detecting means on the jib.

Therefore, the present invention has the effect that the insertion state of the coupling pin can be detected on the jib side even when the coupling pin of the stowing means is provided on the base boom. In other words, the effect is obtained that the pivot pin can be restricted from being retracted even when the coupling pin is provided on the base boom in the jib stowing device according to claim 1 in which the pivot pin is restricted from being retracted depending on the insertion state of the coupling pin of the stowing means.

EMBODIMENT

Description is hereinafter made of a jib stowing device for a jib crane vehicle according to an embodiment of the present invention with reference to FIG. 1 to FIG. 11.

The jib crane vehicle used in this embodiment has a telescopic boom 1 mounted for arcuate movement on a rotating platform equipped on a vehicle, and a jib 2 removably attachable to a distal portion 13 of a top boom 12 of the telescopic boom 1.

The telescopic boom 1 includes a base boom 11, a top boom 12 and a plurality of intermediate booms, and the booms are telescopically connected to each other. In this embodiment, the jib 2 includes a base jib 21, a top jib 22 retractably fitted in the base jib 21, and a jib support 23 attached to a proximal portion of the base jib 21. In this jib 2, the jib support 23 serves as a jib proximal portion.

As shown in FIG. 2 to FIG. 4, the distal portion 13 of the top boom 12 and the jib proximal portion (which is hereinafter referred to as "jib support") 23 are coupled to each other by inserting a pivot pin 30 (upper pivot pin 31 and lower pivot pin 32) into upper and lower bosses (with a pin hole) 14*a* and 14*b* provided on a first side portion of the top boom distal portion 13 and upper and lower bosses (with a pin hole) 24*a* and 24*b* provided on a first side portion of the jib support 23. The top boom distal portion 13 has one upper boss 14*a* and one lower boss 14*b*, and the jib support 23 has two upper bosses 24*a* with a small vertical distance therebetween and two lower bosses 24*b* with a small distance therebetween.

By rotating the jib 2 about the pivot pin 30 in a space on one side of the telescopic boom 1 with the pivot pin 30 (the upper pivot pin 31 and the lower pivot pin 32) inserted in the bosses (14*a* and 24*a*, and 14*b* and 24*b*), the jib 2 can be moved between a stowage position where the jib is disposed along one side of the base boom 11 (FIG. 2) and an extended position where the jib extends in front of the top boom distal portion 13 (not shown).

Stowing means for stowing the jib 2 on a lateral side of the base boom 11 is provided between the base boom 11 and the jib 2, and, in this embodiment, first stowing means A (the detailed configuration of which is described later) located on the distal side on the base boom 11 and second stowing means B located on the proximal side on the base boom 11 are provided as the stowing means as shown in FIG. 1 and FIG. 2. In the jib stowage state shown in FIG. 1, the jib 2 is supported on the lateral side of the base boom 11 by the first stowing means A and the second stowing means B with the pivot pin 30 (the upper pivot pin 31 and the lower pivot pin 32) extracted out of the upper and lower bosses (14*a* and 24*a*, and 14*b* and 24*b*).

While the stowing means disposed between the base boom 11 and the jib 2 preferably include first stowing means A located on the distal side on the base boom 11 and second stowing means B located on the proximal side on the base boom 11 as in this embodiment so that the jib 2 can be supported at two points, only one stowing means may be provided generally at the center of the base boom 11 (in the vicinity of the center of gravity of the jib 2) in another embodiment. In such a case (a case where only one stowing means is provided), the stowing means is the same in configuration as the first stowing means A discussed above.

As shown in FIG. 4 and FIG. 5, the pivot pin 30 has a threaded rod 33 having upper and lower portions with which the upper pivot pin 31 and the lower pivot pin 32, each of which is in the form of a female-threaded cylinder, are threaded, respectively. As shown in FIG. 5, the threaded rod 33 has a right-hand thread 33*a* formed on the upper half thereof and a left-hand thread 33*b* formed on the lower half thereof, and is provided with a rotary tool coupling portion 34 for coupling a rotary tool for rotating the threaded rod at its lower end. The upper pivot pin 31 is threaded with the right-hand thread 33*a* formed on the upper half of the threaded rod 33, and the lower pivot pin 32 is threaded with the left-hand thread 33*b* formed on the lower half of the threaded rod 33.

The pivot pin 30 is disposed to extend between the upper and lower bosses 24*a* and 24*b* on the jib support 23 as shown in FIG. 5. The upper pivot pin 31 and the lower pivot pin 32 of the pivot pin 30 have vertical grooves 31*a* and 32*a*, respectively, formed in an outer surface thereof and anti-rotation pins (bolts) 38 and 38 are inserted in the vertical grooves 31*a* and 32*a* from the side of the upper and lower bosses 24*a* and 24*b* so that the upper pivot pin 31 and the lower pivot pin 32 cannot rotate together with the threaded rod 33.

The upper pivot pin 31 and the lower pivot pin 32 of the pivot pin 30 can be simultaneously retracted out of or inserted into the upper and lower bosses 14*a* and 14*b* on the top boom distal portion 13 by manually rotating the threaded rod 33 to the right or left. In other words, the upper pivot pin 31 and the lower pivot pin 32 are simultaneously moved toward each other (to the pin retracting side) when the rotary tool coupling portion 34 at the lower end of the threaded rod 33 is rotated to the right (as viewed from below) with a rotary tool, and the upper pivot pin 31 and the lower pivot pin 32 are simultaneously moved away from each other (to the pin inserting side) when the rotary tool is rotated to the left (as viewed from below).

The state shown in FIG. 5 is a state where the upper pivot pin 31 and the lower pivot pin 32 have been inserted into the upper and lower bosses 14*a* and 14*b*, respectively, on the top boom distal portion 13. In this state, a gap T with a considerable length is formed between the lower end of the upper pivot pin 31 and the upper end of the lower pivot pin 32 on the outside of the threaded rod 33, and a restricting member 71, which is described later, can enter the gap T.

As shown in FIG. 4 and FIG. 9, the first stowing means A has upper bosses (with a pin hole) 17*a* and lower bosses (with a pin hole) 17*b* provided at two vertically separated locations on a lateral side of the base boom 11, an upper boss (with a pin hole) 27*a* and a lower boss (with a pin hole) 27*b* provided at two vertically separated locations on a lateral side of the base jib 21, and a coupling pin 40 for coupling and uncoupling the upper and lower bosses (17*a* and 27*a*, and 17*b* and 27*b*).

The upper and lower bosses 17*a* and 17*b* on the base boom 11 are provided transversely on a mounting base 16 disposed on a lateral side of the base boom 11. The upper and lower bosses 27*a* and 27*b* on the base jib 21 are provided transversely on a mounting base 26 disposed on a lateral side of the base jib 21. The base boom 11 has two upper bosses 17*a* with a small vertical distance therebetween and two lower bosses with a small vertical distance therebetween, and the base jib 21 has one upper boss 27*a* and one lower boss 27*b*.

The coupling pin 40 has the same structure as the pivot pin 30. That is, the coupling pin 40 has a threaded rod 43 with which an upper coupling pin 41 and a lower coupling pin 42, each of which is in the form of a female-threaded cylinder, are threaded at upper and lower portions thereof, respectively. As shown in FIG. 9, the threaded rod 43 has a right-hand thread 43*a* formed on the upper half thereof and a left-hand thread 43*b* formed on the lower half thereof, and is provided with a rotary tool coupling portion 44 for coupling a rotary tool for rotating the threaded rod at its lower end. The upper coupling pin 41 is threaded with the right-hand thread 43*a* formed on the upper half of the threaded rod 43, and the lower coupling pin 42 is threaded with the left-hand thread 43*b* formed on the lower half of the threaded rod 43.

As shown in FIG. 9, the coupling pin 40 is disposed to extend between the upper and lower bosses 17*a* and 17*b* on the mounting base 16 on the base boom 11. The upper coupling pin 41 and the lower coupling pin 42 of the coupling pin 40 have vertical grooves 41*a* and 42*a*, respectively, formed in an outer surface thereof and anti-rotation pins (bolts) 48 and 48 are inserted in the vertical grooves 41*a* and 42*a* from the side of the upper and lower bosses 17*a* and 17*b* so that the upper coupling pin 41 and the lower coupling pin 42 cannot rotate together with the threaded rod 43.

The upper coupling pin 41 and the lower coupling pin 42 of the coupling pin 40 can be simultaneously retracted out of or inserted into the upper and lower bosses 27*a* and 27*b* on the base jib 21 by manually rotating the threaded rod 43 to the right or left. In other words, the upper coupling pin 41 and lower coupling pin are simultaneously moved toward each other (to the pin retracting side) when the rotary tool coupling portion 44 at the lower end of the threaded rod 43 is rotated to the right (as viewed from below) with a rotary tool, and the upper coupling pin 41 and the lower coupling pin 42 are simultaneously moved away from each other (to the pin inserting side) when the rotary tool is rotated to the left (as viewed from below).

In the jib crane vehicle according to this embodiment, the operations to extend and stow the jib are performed as described below.

First, in a jib stowage position, the boss 14*a* (the lower boss 14*b* is below it) on the top boom distal portion 13 and the boss 24*a* (the lower boss 24*b* is below it) on the jib support 23 are uncoupled from each other (the upper pivot pin 31 and the lower pivot pin 32 are adjacent to each other as shown in FIG. 8) and the jib 2 is supported in a position extending along one side of the base boom 11 by the first stowing means A located on the distal side on the base boom 11 and the second stowing means B located on the proximal side on the base boom 11 as shown in FIG. 1. At this time, the upper coupling pin 41 and the lower coupling pin 42 of the coupling pin 40 of the first stowing means A are separate from each other and couples the upper and lower bosses (17*a* and 27*a*, and 17*b* and 27*b*) as shown in FIG. 9. In the jib stowage state, the telescopic boom 1 can be extended and contracted with the jib 2 stowed on a lateral side of the base boom 11.

To bring the jib 2 from the stowage position (FIG. 1) to an extended position, the second stowing means B on the proximal side on the base boom is uncoupled (so that the jib 2 can be swung about the coupling pin 40 of the first stowing means A) with the telescopic boom 1 fully contracted, and the boss 14*a* (14*b*) on a first side portion of the top boom distal portion 13 and the boss 24*a* (24*b*) on a first side portion of the jib support 23 are aligned with each other as shown in FIG. 2 (the state shown in FIG. 8). Then, the rotary tool coupling portion 34 of the threaded rod 33 of the pivot pin 30 is rotated to the left (to separate the upper pivot pin 31 and the lower pivot pin 32 from each other) to couple the upper bosses 14*a* and 24*a* to each other by the upper pivot pin 31 and to couple the lower bosses 14*b* and 24*b* to each other by the lower pivot pin 32. Thereafter, when the threaded rod 43 of the coupling pin 40 of the first stowing means A is rotated to the right to retract the upper coupling pin 41 and the lower coupling pin 42 out of the upper and lower bosses 27*a* and 27*b*, respectively, on the base jib 21, the entire jib 2 can be rotated about the pivot pin 30 (the upper pivot pin 31 and the lower pivot pin 32) in a space on one side of the telescopic boom 1. Then, the jib 2 can be set in an extend position by rotating the jib 2 to the front of the top boom distal portion 13, aligning the bosses on the non-pivot side of the jib support 23 with the bosses on the non-pivot side of the top boom distal portion 13, and inserting another coupling pin into the bosses.

When the jib 2 is moved from the stowage position to the extended position, or when the jib 2 is moved from the extended position to the stowage position, it is necessary to insert and retract the pivot pin 30 and the coupling pin 40 alternatively. In an ordinary jib stowing device, there is a possibility of both the pivot pin 30 and the coupling pin 40 being retracted simultaneously by an erroneous operation as described in the section of "Background Art." In this case, there is a danger of the jib falling off.

Therefore, the jib stowing device according to this embodiment is provided with a safety mechanism to prevent both the pivot pin 30 and the coupling pin 40 from being retracted simultaneously during operations to extend and stow the jib 2.

That is, the safety mechanism includes, in the jib stowing device having the above configuration, pivot pin insertion state detecting means 5 provided on the jib 2 for mechanically detecting whether or not the pivot pin 30, which serves as a pivot for jib rotation, is in an inserted position, pivot pin retraction restricting means 7 for mechanically restricting movement of the pivot pin 30 to a retract side, coupling pin insertion state detecting means 6 for mechanically detecting whether or not the coupling pin 40 of the first stowing means A is in an inserted position, coupling pin retraction restricting means 8 for mechanically restricting movement of the coupling pin 40 to a retracting side, first associating means 91 for mechanically associating the pivot pin insertion state detecting means 5 and the coupling pin retraction restricting means 8, and second associating means 94 for mechanically associating the coupling pin insertion state detecting means 6 and the pivot pin retraction restricting means 7. It should be noted that the term "mechanically" in these means (5, 6, 7, 8, 91 and 94) refers to achieve their functions without the use of any power such as electricity or hydraulic pressure. In this embodiment, these means (5, 6, 7, 8, 91 and 94) are constituted as described below.

As the pivot pin insertion state detecting means 5, a protrusion 51 secured to the upper pivot pin 31 is employed as shown in FIG. 3 to FIG. 6 and FIG. 11. The protrusion 51 can move vertically in accordance with vertical movement of the upper pivot pin 31 to detect the insertion state of the upper and lower pivot pins 31 and 32. Because the upper and lower pivot pins 31 and 32 are simultaneously moved toward or away from each other by the threaded rod 33, the insertion state of both the pins 31 and 32 can be detected by detecting vertical movement of one of the pivot pins (the upper pivot pin 31).

The pivot pin retraction restricting means 7 has a restricting member 71 pivoted at a position in the vicinity of the pivot pin 30 for swinging movement toward and away from the threaded rod 33 of the pivot pin 30 as shown in FIG. 3 to FIG. 6 and FIG. 11 (especially in FIG. 5 and FIG. 6). As shown in FIG. 5, the restricting member 71 has a height which is slightly smaller than the width of the gap T between the lower end of the upper pivot pin 31 and the upper end of the lower pivot pin 32 at the time when the upper and lower pivot pin 31 and 32 are inserted in the upper and lower bosses 14*a* and 14*b*, respectively, on the top boom distal portion 13. The restricting member 71 is pivoted by a shaft 72 on a mounting base 29 provided on the jib support 23 as shown in FIG. 6.

The restricting member 71 is provided with two arms 73 and 74 extending outward in opposite directions, and one of the arms, the arm 74, is urged in a direction in which the restricting member 71 approaches the threaded rod 33 of the pivot pin 30 by a spring 75. A first end 96*a* of an inner cable 96 of the second associating means (control cable) 94, which is described later, is coupled to the other arm 73 of the restricting member 71.

When the restricting member 71 is in a free state, the restricting member 71 is swung by the urging force of the spring 75 to a position where it abuts against (or is adjacent to) an outer surface of the threaded rod 33 as indicated by dotted lines (reference numeral 71') in FIG. 6. Therefore, when the restricting member 71 is brought into the free state with the upper and lower pivot pins 31 and 32 inserted in the bosses 14*a* and 14*b*, respectively, on the top boom distal portion 13 as shown in FIG. 5, the restricting member 71 enters the gap T between the lower end of the upper pivot pin 31 and the upper end of the lower pivot pin 32 by the urging force of the spring 75. The restricting member 71 can enter the gap T between the lower end of the upper pivot pin 31 in an inserted state and the upper end of the lower pivot pin 32 in an inserted state with clearances above and below it. However, when the threaded rod 33 is operated to the pivot pin retracting side (rotated to the left) with the restricting member 71 positioned in the gap T, the lower end of the upper pivot pin 31 and the upper end of the lower pivot pin 32 abut against the upper and lower faces, respectively, of the restricting member 71 before the upper and lower pivot pins 31 and 32 are retract out of the upper and lower bosses 14*a* and 14*b* on the top boom distal portion 13 as shown in FIG. 7 and the threaded rod 33 cannot be further rotated to the pivot pin retracting side after the abutment. While the lower end of the upper pivot pin 31 and the upper end of the lower pivot pin 32 simultaneously abut against the upper and lower faces of the restricting member 71 in the state shown in FIG. 7, only either one of the upper pivot pin 31 or the lower pivot pin 32 may be configured to abut against the restricting member 71.

As the coupling pin insertion state detecting means 6, an L-shaped lever 61 which swings in accordance with vertical movement of the upper coupling pin 41 is employed as shown in FIG. 4 and FIG. 9 to FIG. 11. The L-shaped lever 61 is pivoted at the corner of the L-shaped body by a shaft 62 at a position in the vicinity of the upper coupling pin 41 in the jib stowage state on the mounting base 26 on the base jib 21. A protrusion 63 protrudes from a first lever end of the L-shaped lever 61 toward the upper coupling pin 41. A push plate 64 against which the protrusion 63 is abuttable is attached to an outer surface of the upper coupling pin 41.

The L-shaped lever 61 on the base jib 21 and the protrusion 63 on the upper coupling pin 41 are configured such that the L-shaped lever 61 is separated from the push plate 64 when the jib 2 is separated from the base boom 11 and the protrusion 63 of the L-shaped lever 61 is engaged with the push plate 64 on the upper coupling pin 41 when the jib 2 is located in the stowage position on one side of the base boom 11.

The coupling pin insertion state detecting means 6 swings a second lever end of the L-shaped lever 61 in the jib length direction via the protrusion 63 when the push plate 64 moves vertically in accordance with vertical movement of the upper coupling pin 41, and can detect the insertion state of the upper and lower coupling pins 41 and 42 based on the amount by which the second lever end is swung. Because the upper and lower coupling pins 41 and 42 of the coupling pin 40 are also simultaneously moved toward or away from each other by the threaded rod 43, the insertion state of both the coupling pins 41 and 42 can be detected by detecting a vertical movement of one of the coupling pins (the upper coupling pin 41).

The coupling pin retraction restricting means 8 has a restricting member 81 pivoted at a position in the vicinity of the coupling pin 40 of the first stowing means A for swinging movement toward and away from the threaded rod 43 of the coupling pin 40 as shown in FIG. 3 to FIG. 4 and FIG. 9 to FIG. 11 (especially FIG. 9 and FIG. 10). As shown in FIG. 9, the restricting member 81 has a height which is slightly smaller than the width of the gap S between the lower end of the upper coupling pin 41 and the upper end of the lower coupling pin 42 at the time when the upper and lower coupling pins 41 and 42 are inserted in the upper and lower bosses 27*a* and 27*b*, respectively, on the base jib 21. The restricting member 81 is pivoted by a shaft 82 on the mounting base 26 provided on the base jib as shown in FIG. 10. The restricting member 81 is provided with an arm 84 extending outward, and the arm 84 is urged in a direction in which the restricting member 81 approaches the threaded rod 43 of the coupling pin 40 by a spring 85. When the restricting member 81 is in a free state, the restricting member 81 is swung by the spring 85 to a position where it abuts against (or is adjacent to) an outer surface of the threaded rod 43 as indicated by dotted lines (reference numeral 81') in FIG. 10. Therefore, when the restricting member 81 is brought into the free state with the upper and lower coupling pins 41 and 42 inserted in the bosses 27*a* and 27*b*, respectively, on the base jib 21 as shown in FIG. 9, the restricting member 81 enters the gap S between the lower end of the upper coupling pin 41 and the upper end of the lower coupling pin 42 by the urging force of the spring 85.

As each of the first associating means 91 and the second associating means 94, a control cable is employed. Each of the control cables 91 and 94 has an outer casing 92 and an inner cable 93 movably received in the outer casing 92.

Both ends of the outer casing 92 of the control cable 91 as the first associating means are unmovably secured, and the inner cable 93 has a first end 93*a* coupled to the protrusion 51 as the pivot pin insertion state detecting means 5 as shown in FIG. 5 to FIG. 6 and FIG. 11 and a second end 93*b* coupled to the arm 84 of the restricting member 81 of the coupling pin retraction restricting means 8 as shown in FIG. 9 to FIG. 10 and FIG. 11. The first associating means (control cable) 91 can swing the restricting member 81 of the coupling pin retraction restricting means 8 between a non-restricting position (the position indicated by reference numeral 81 in FIG. 10) and a restricting position (the position indicated by reference numeral 81' in FIG. 10) via the pivot pin insertion state detecting means 5 (the protrusion 51) and the inner cable 93 thereof when the upper pivot pin 31 of the pivot pin 30 moves vertically. In other words, the inner cable 93 is pulled and the restricting member 81 of the coupling pin retraction restricting means 8 is moved against the urging force of the spring 85 to the non-restricting position indicated by solid lines in FIG. 10 when the upper pivot pin 31 is moved upward (both the upper and lower pivot pins 31 and 32 are inserted) as shown in FIG. 5 and FIGS. 11(B) and (C), and the inner cable 93 is pushed (released from a tension) and the restricting member 81 of the coupling pin retraction restricting means 8 is moved to the restricting position indicated by dotted lines in FIG. 10 (reference numeral 81') by the urging force of the spring 85 when the upper pivot pin 31 is moved downward (both the upper and lower pivot pins 31 and 32 are retracted) as shown in FIG. 8 and FIG. 11(A).

Both ends of the outer casing 95 of the control cable 94 as the second associating means are unmovably secured and the inner cable 96 has a first end 96*a* coupled to the arm 73 of the restricting member 71 of the pivot pin retraction restricting means 7 as shown in FIG. 5 to FIG. 6 and FIG. 11 and a second end 96*b* coupled to one of lever ends of the L-shaped lever 61 of the coupling pin insertion state detecting means 6 as shown in FIG. 9 to FIG. 10 and FIG. 11. The second associating means (control cable) 94 can swing the restricting member 71 of the pivot pin retraction restricting means 7 between a non-restricting position (the position indicated by reference numeral 71 in FIG. 6) and a restricting position (the position indicated by reference numeral 71' in FIG. 6) via the coupling pin insertion state detecting means 6 (the L-shaped lever 61) and the inner cable 96 when the upper coupling pin 41 of the coupling pin 40 is moved vertically. In other words, the restricting member 71 of the pivot pin retraction restricting means 7 is moved against the urging force of the spring 75 to the non-restricting position indicated by solid lines in FIG. 6 because the L-shaped lever 61 is swung to the inner cable pulling side via the push plate 64 and the protrusion 63 and pulls the inner cable 96 when the upper coupling pin 41 is moved upward (both the upper and lower coupling pins 41 and 42 are inserted) as shown in FIG. 9 and FIGS. 11(A) and (B), and the inner cable 96 is pushed (released from a tension) and the restricting member 71 of the pivot pin retraction restricting means 7 is moved to the restricting position indicated by dotted lines in FIG. 6 (reference numeral 71') by the urging force of the spring 75 when the upper coupling pin 41 is moved downward (the upper and lower coupling pins 41 and 42 are retracted) as shown in FIG. 11(C).

In the jib stowing device according to this embodiment, each of the above means (5, 6, 7, 8, 91 and 94) functions as described below during the operations to extend and stow the jib 2. Each change in operation during the operations to extend and stow the jib 2 and the functions during these operations are described in conjunction with FIGS. 11(A), (B) and (C).

[Jib Extending Operation]

When the jib 2 is extended from the stowed state shown in FIG. 1, the second stowing means B is first uncoupled and then the jib 2 is swung about the coupling pin 40 of the first stowing means A to align the upper and lower bosses 24*a* and 24*b* on a first side portion of the jib proximal portion (jib support) 23 with the upper and lower bosses 14*a* and 14*b* on a first side portion of the top boom distal portion 13 as shown in FIG. 2. in this state, the upper and lower coupling pins 41 and 42 are in the inserted state and the restricting member 71 of the pivot pin retraction restricting means 7 is located in the non-restricting position via the coupling pin insertion state detecting means 6 and the second associating means (control cable) 94 as shown in FIG. 11(A). In addition, the upper and lower pivot pins 31 and 32 are located adjacent to each other (retracted) and the restricting member 81 of the coupling pin retraction restricting means 8 is located in the restricting position by the urging force of the spring 85. Therefore, the coupling pin 40 (the upper and lower coupling pins 41 and 42) cannot be retracted (the threaded rod 43 cannot be operated to the coupling pin retracting side).

Next, in the state shown in FIG. 11(A) and FIG. 8, the threaded rod 33 of the pivot pin 30 is rotated to the left to move the upper pivot pin 31 upward and move the lower pivot pin 32 downward to insert the upper and lower pivot pins 31 and 32 into the upper and lower bosses (14*a* and 24*a*, and 14*b* and 24*b*), respectively, aligned with each other (to establish the state shown in FIG. 11(B)). In this state shown in FIG. 11(B), the pivot pin insertion state detecting means 5 (the protrusion 51) and the first associating means (control cable) 91 function to place the restricting member 81 of the coupling pin retraction restricting means 8 in the non-restricting position (coupling pin retracting operation by the threaded rod 43 can be performed) because the upper pivot pin 31 has been moved upward.

Next, to rotate the jib 2 away from the base boom 11 from the state shown in FIG. 2, the threaded rod 43 of the coupling pin 40 is operated to the coupling pin retracting side to retract the upper and lower coupling pins 41 and 42 as shown in FIG. 11(C). The coupling pin retracting operation by the threaded rod 43 can be performed only when the upper and lower pivot pins 31 and 32 of the pivot pin 30 are in the inserted state as shown in FIG. 11(B). That is, even if the threaded rod 43 of the coupling pin 40 is operated by mistake to the coupling pin retracting side when the pivot pin 30 is in the retracted state as shown in FIG. 11(A), the operation is not effective. This securely prevents a situation in which both the pivot pin 30 and the coupling pin 40 are retracted during a coupling pin retracting operation.

When the upper and lower coupling pins 41 and 42 of the coupling pin 40 are brought into the retracted state as shown in FIG. 11(C), the restriction releasing effect of the coupling pin insertion state detecting means 6 and the second associating means (control cable) 94 on the restricting member 71 of the pivot pin retraction restricting means 7 is released and the restricting member 71 is moved to the restricting position by the urging force of the spring 75 (FIG. 6).

After the jib 2 has been rotated to the front of the top boom distal portion 13, the jib extending operation is completed when the bosses (provided at two vertically separated locations) on a second side portion of the jib support 23 and the bosses (provided at two vertically separated locations) on a second side portion of the top boom distal portion 13 are aligned with each other and another coupling pin is inserted into the bosses aligned with each other.

[Jib Stowing Operation]

To stow the jib 2 from the extend state, the jib 2 is rotated to a position along the base boom 11 shown in FIG. 2 with the jib proximal portion (jib support) 23 and the top boom distal portion 13 coupled to each other only by the pivot pin 30 to align the upper and lower bosses 27*a* and 27*b* on the base jib 21 with the upper and lower bosses 17*a* and 17*b* on the base boom 11. At this time, the protrusion 63 of the L-shaped lever 61 as the coupling pin insertion state detecting means 6 on the jib side is engaged with the push plate 64 on the upper coupling pin 41. Then, the upper and lower coupling pins 41 and 42 of the first stowing means A are inserted into the upper and lower bosses (17*a* and 27*a*, and 17*b* and 27*b*) on the base jib 21 and the base boom 11 aligned with each other (to establish the state shown in FIG. 11(B)). In the state shown in FIG. 11(B), the restricting member 71 of the pivot pin retraction restricting means 7 and the restricting member 81 of the coupling pin retraction restricting means 8 are both in the non-restricting position, so that the threaded rods 33 and 43 can performs a pin retracting operation.

Next, the threaded rod 33 of the pivot pin 30 is operated from the state shown in FIG. 2 and FIG. 11(B) to the pivot pin retracting side to retract the upper and lower pivot pins 31 and 32 as shown in FIG. 11(A). The pivot pin retracting operation by the threaded rod 33 can be performed only when the upper and lower coupling pins 41 and 42 of the coupling pin 40 are in the inserted state as shown in FIG. 11(B). That is, even if the threaded rod 33 of the pivot pin 30 is operated to the pivot pin retracting side by mistake when the coupling pin 40 is in the retracted state as shown in FIG. 11(C), the operation is not effective because the restricting member 71 of the pivot pin retraction restricting means 7 is in the restricting position. This securely prevents a situation in which both the pivot pin 30 and the coupling pin 40 are retracted during a pivot pin retracting operation.

When the upper and lower pivot pins 31 and 32 of the pivot pin 30 are brought into the retract state as shown in FIG. 11(A), the restriction releasing effect of the pivot pin insertion state detecting means 5 and the first associating means (control cable) 91 on the restricting member 81 of the coupling pin retraction restricting means 8 is released and the restricting member 81 is moved to the restricting position by the urging force of the spring 85 (FIG. 10).

Then, the jib stowing operation is completed when the distal portion of the jib is moved from the state shown in FIG. 2 and FIG. 11(A) about the coupling pin 40 toward a lateral side of the base boom 11 and the distal portion of the jib is coupled to the base boom 11 by the second stowing means B as shown in FIG. 1.

As described foregoing, in the jib stowing device for a jib crane vehicle according to this embodiment, both when the jib 2 is extended from the stowed state and when the jib 2 is stowed from the extended state, even if either the pivot pin 30 or the coupling pin 40 undergoes a retracting operation by mistake, the operated pin is not retracted (pulled out) if the other of the pivot pin 30 or the coupling pin 40 is in the retracted state (uncoupled state). Thus, a trouble of both the pivot pin 30 and the coupling pin 40 being pulled out by an erroneous operation can be prevented from occurring both during a jib stowing operation and during a jib extending operation. Therefore, safety can be secured both when the jib 2 is stowed and when the jib 2 is extended (the possibility of the jib falling off is eliminated).

Also, the pivot pin insertion state detecting means 5, the coupling pin insertion state detecting means 6, the pivot pin retraction restricting means 7, the coupling pin retraction restricting means 8, the first associating means 91, and the second associating means 94 are collectively provided on the jib. Therefore, each of the means (5, 6, 7, 8, 91 and 94) does not interfere with the extension and contraction of the boom even when a crane operation (extension and contraction of the boom) is performed only with the telescopic boom 1 in the jib stowage state (state in which the jib 2 is separate from the top boom 12).

In addition, because each of the above means (5, 6, 7, 8, 91 and 94) is mechanically installed, there is no need to provide a connector for power source connection (requiring connecting and disconnecting operations) between the telescopic boom 1 and the jib 2 or to provide a control controller, and the safety during stowage and extension of the jib can be secured with a simple configuration in contrast to means which operates on electricity or hydraulic pressure.

Further, in the illustrated embodiment, the coupling pin insertion state detecting means 6 (the L-shaped lever 61) is configured to be removably engageable with the upper coupling pin 41 (the protrusion 63). Thus, even when the coupling pin 40 is provided on the base boom 11 and the coupling pin insertion state detecting means 6 is provided on the base jib 21, the L-shaped lever 61 is engageable with the protrusion 63 when the jib 2 is placed along one side of the base boom 11 so that the insertion state of the coupling pin (the upper coupling pin 41) can be detected by the coupling pin insertion state detecting means 6. Therefore, even when the coupling pin 40 must be provided on the base boom 11 as in the case where the upper and lower coupling pins 41 and 42 are inserted and retracted with a hydraulic cylinder, the insertion state of the coupling pin 40 can be detected on the jib side.

While a control cable is used as the first associating means 91 and the second associating means 94 in the above embodiment, a link mechanism may be used as the first associating means 91 and the second associating means 94 instead of the control cable in another embodiment.

DESCRIPTION OF REFERENCE NUMERALS

Figure 1:
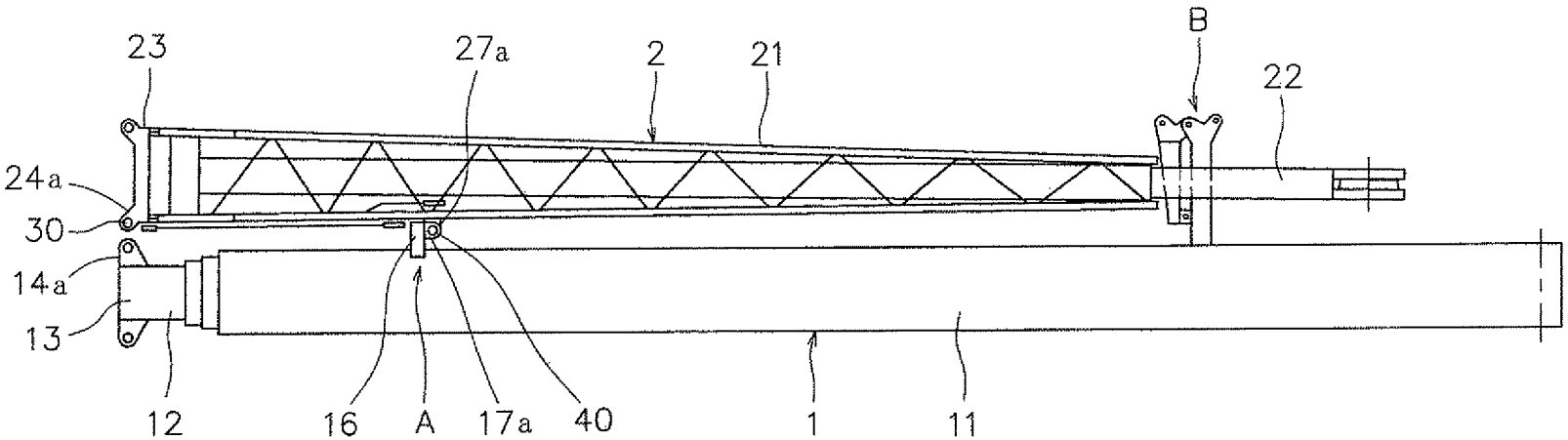
FIG. 1 is a plan view illustrating a jib stowage state of a jib crane vehicle employing a jib stowing device according to an embodiment of the present invention.
Figure 2:
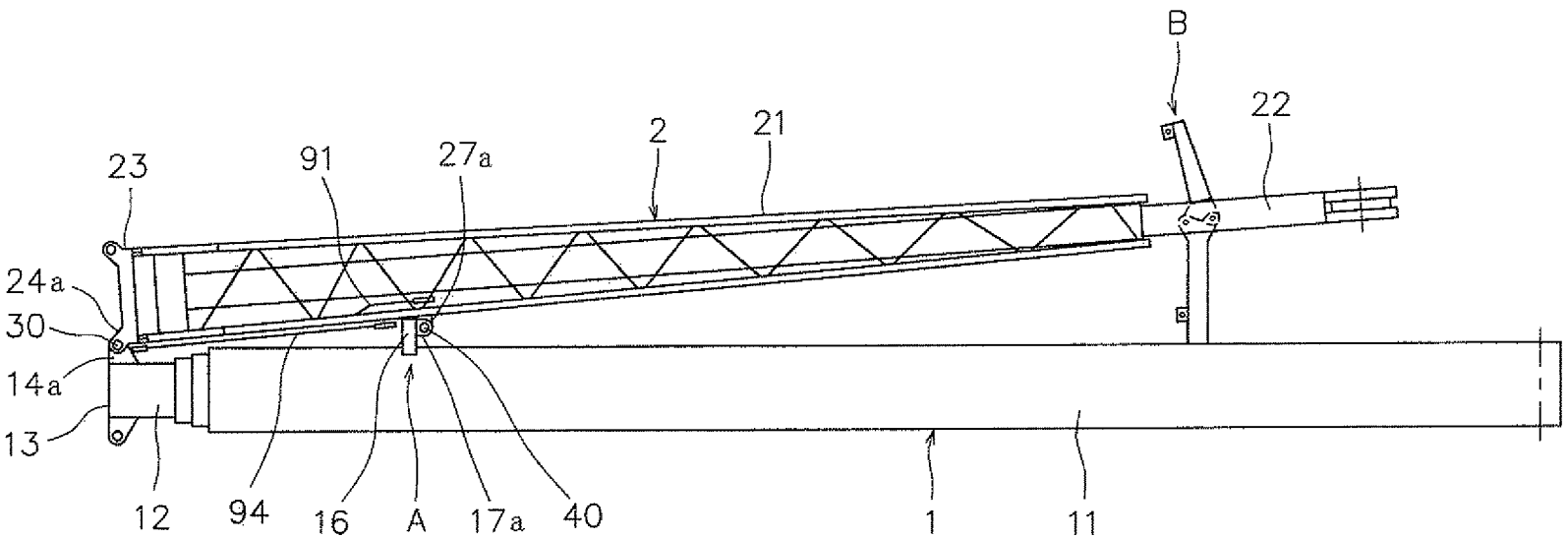
FIG. 2 is a view illustrating a state changed from the state shown in FIG. 1.
Figure 3:
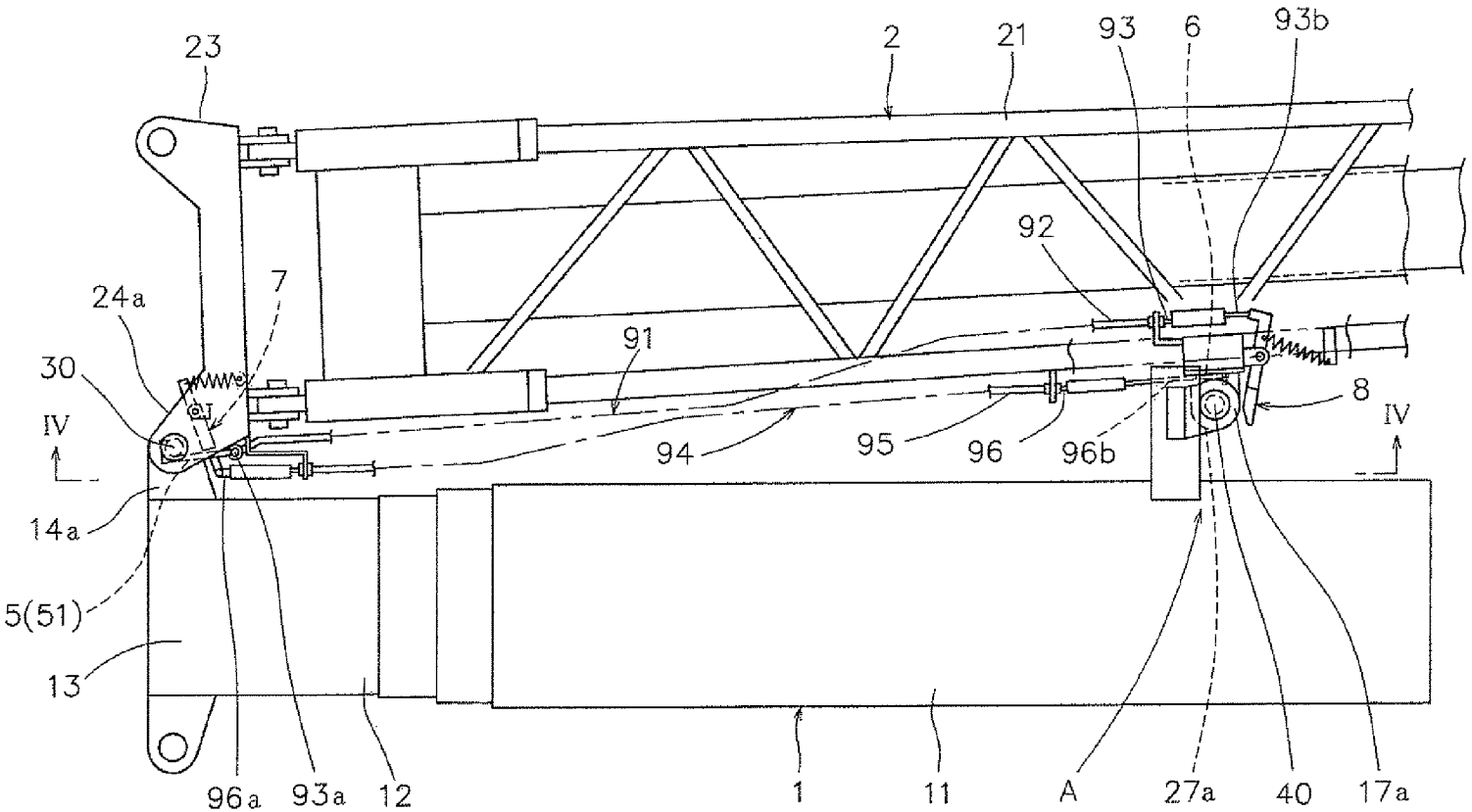
FIG. 3 is an enlarged view of a part of FIG. 2.
Figure 4:
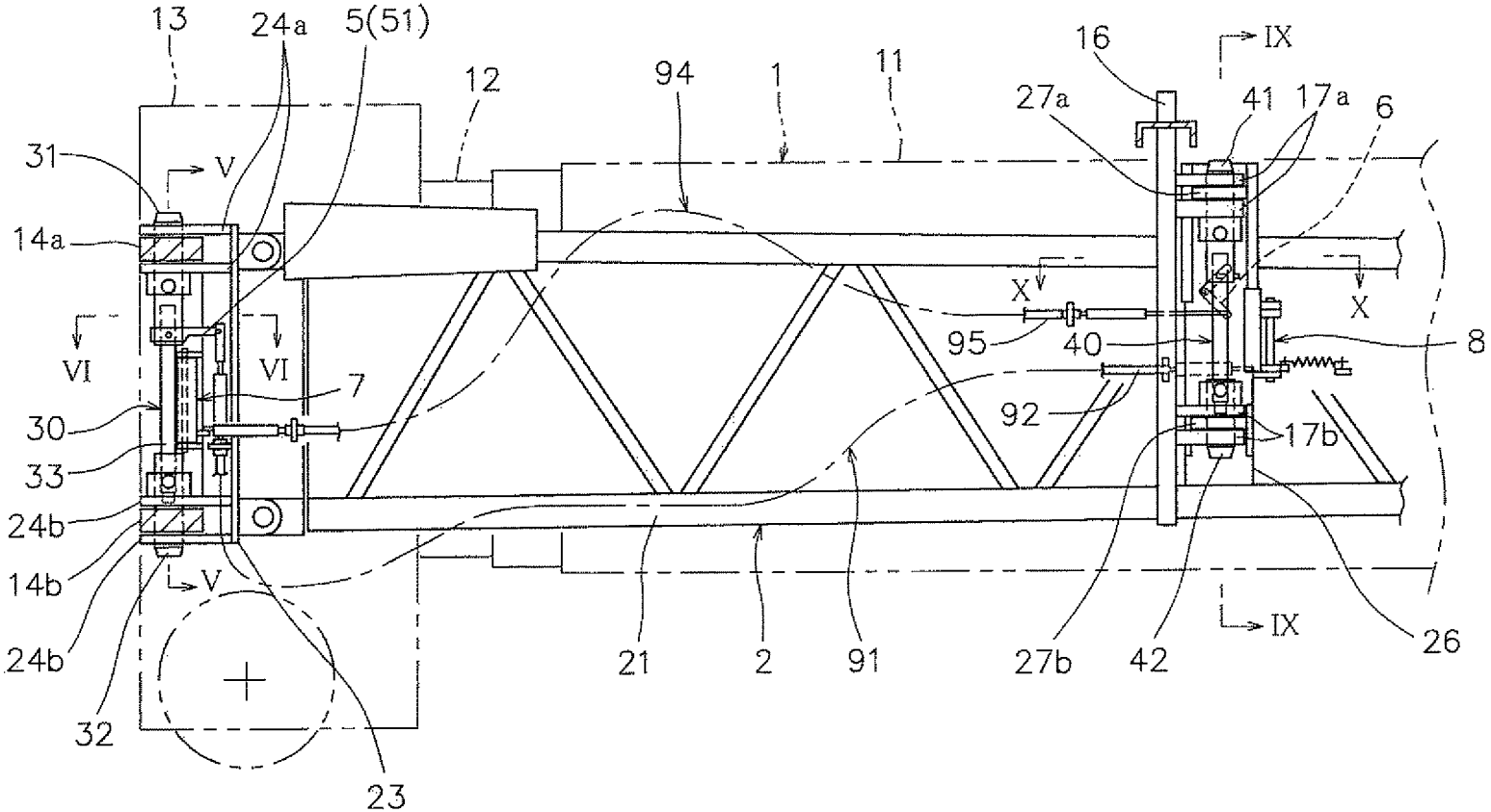
FIG. 4 is a view taken along the line IV-IV of FIG. 3 and viewed in the direction of appended arrows.
Figure 5:
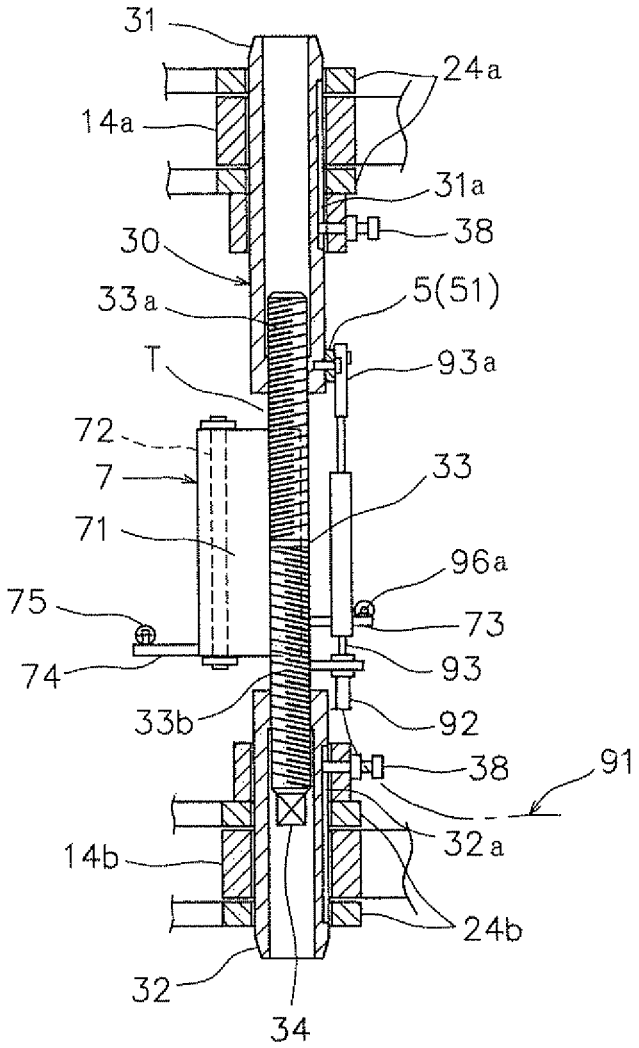
FIG. 5 is a cross-sectional view taken along the line V-V of FIG. 4.
Figure 6:
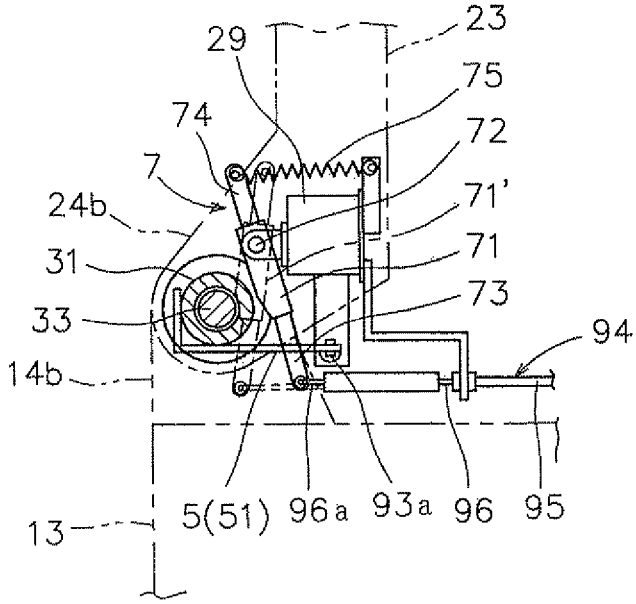
FIG. 6 is a cross-sectional view taken along the line VI-VI of FIG. 4.
Figure 7:
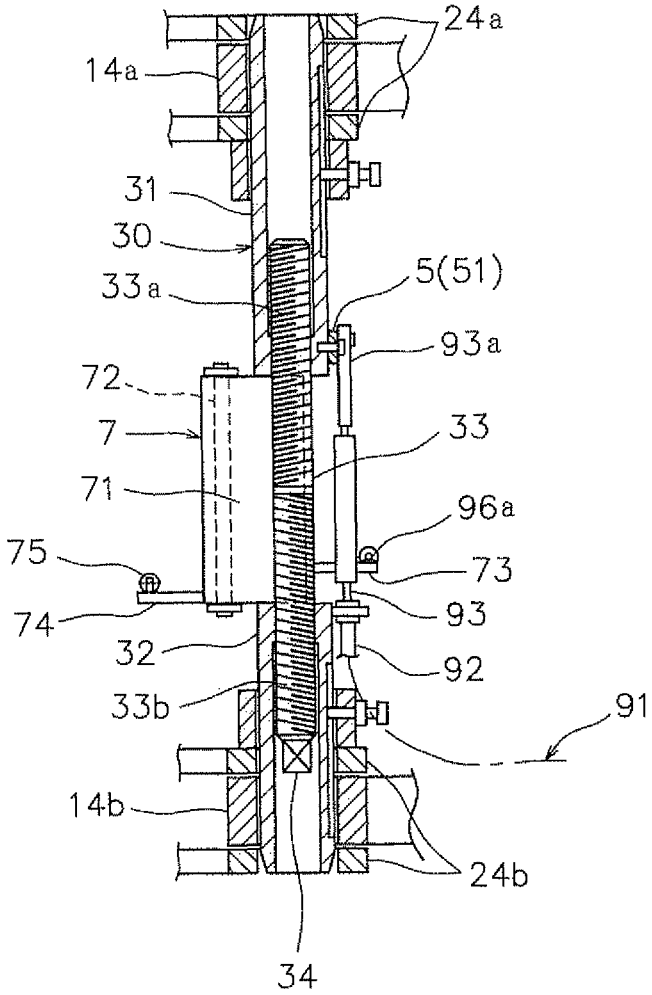
FIG. 7 is a view illustrating a state changed from the state shown in FIG. 5 (view for explaining a retraction disabled state of upper and lower pivot pins).
Figure 8:
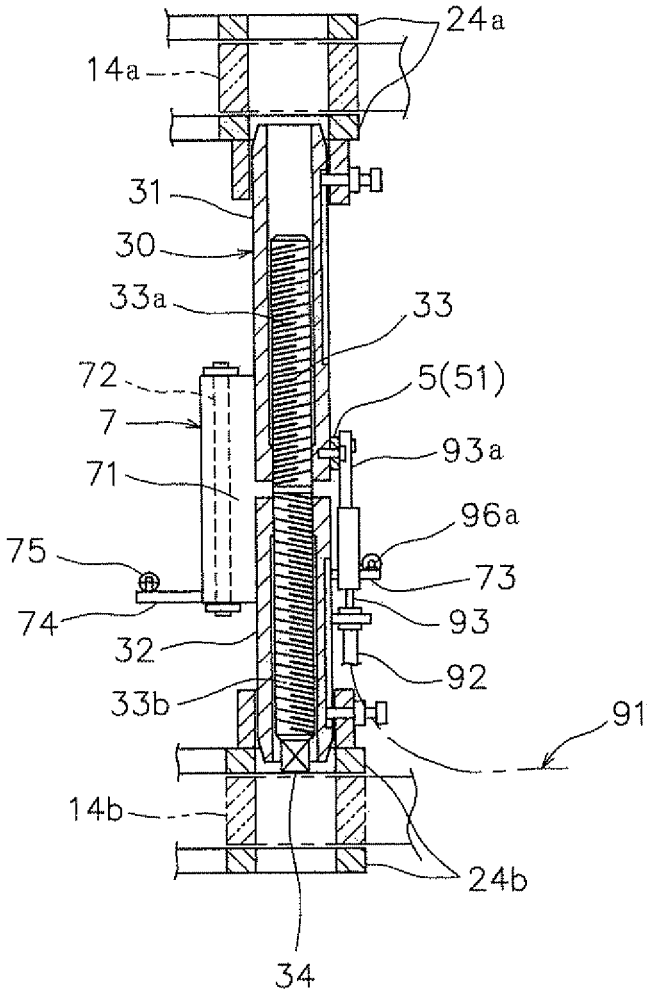
FIG. 8 is a view illustrating a state changed from the state shown in FIG. 5 (view explaining a retracted state of the upper and lower pivot pins).
Figure 9:
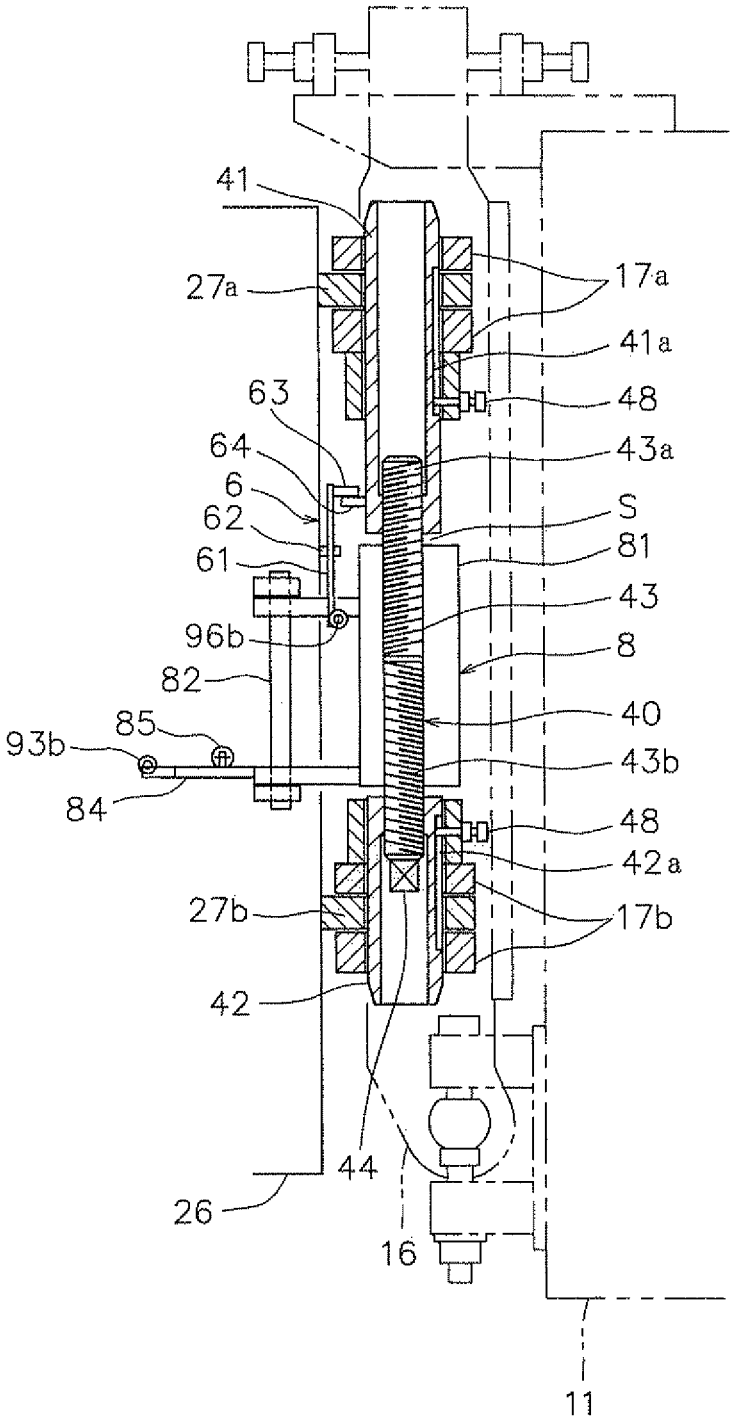
FIG. 9 is a cross-sectional view taken along the line IX-IX of FIG. 4.
Figure 10:
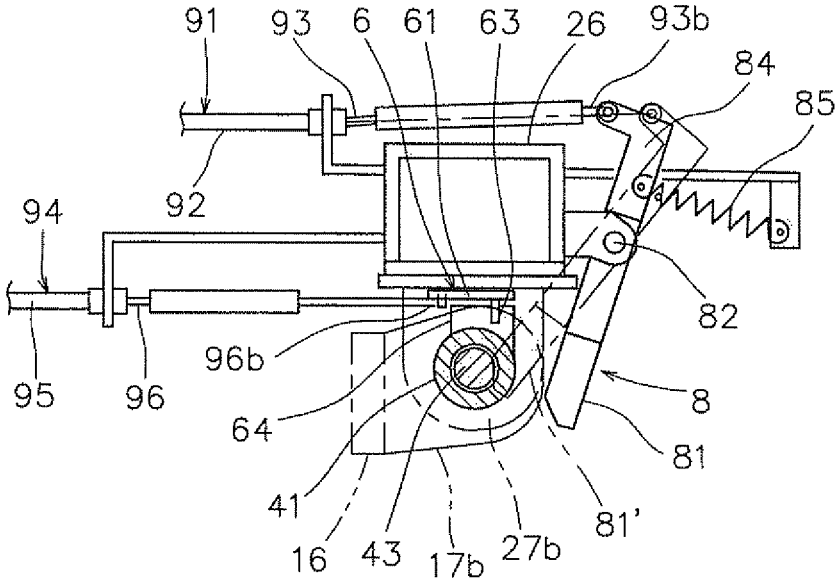
FIG. 10 is a cross-sectional view taken along the line X-X of FIG. 4.
Figure 11:
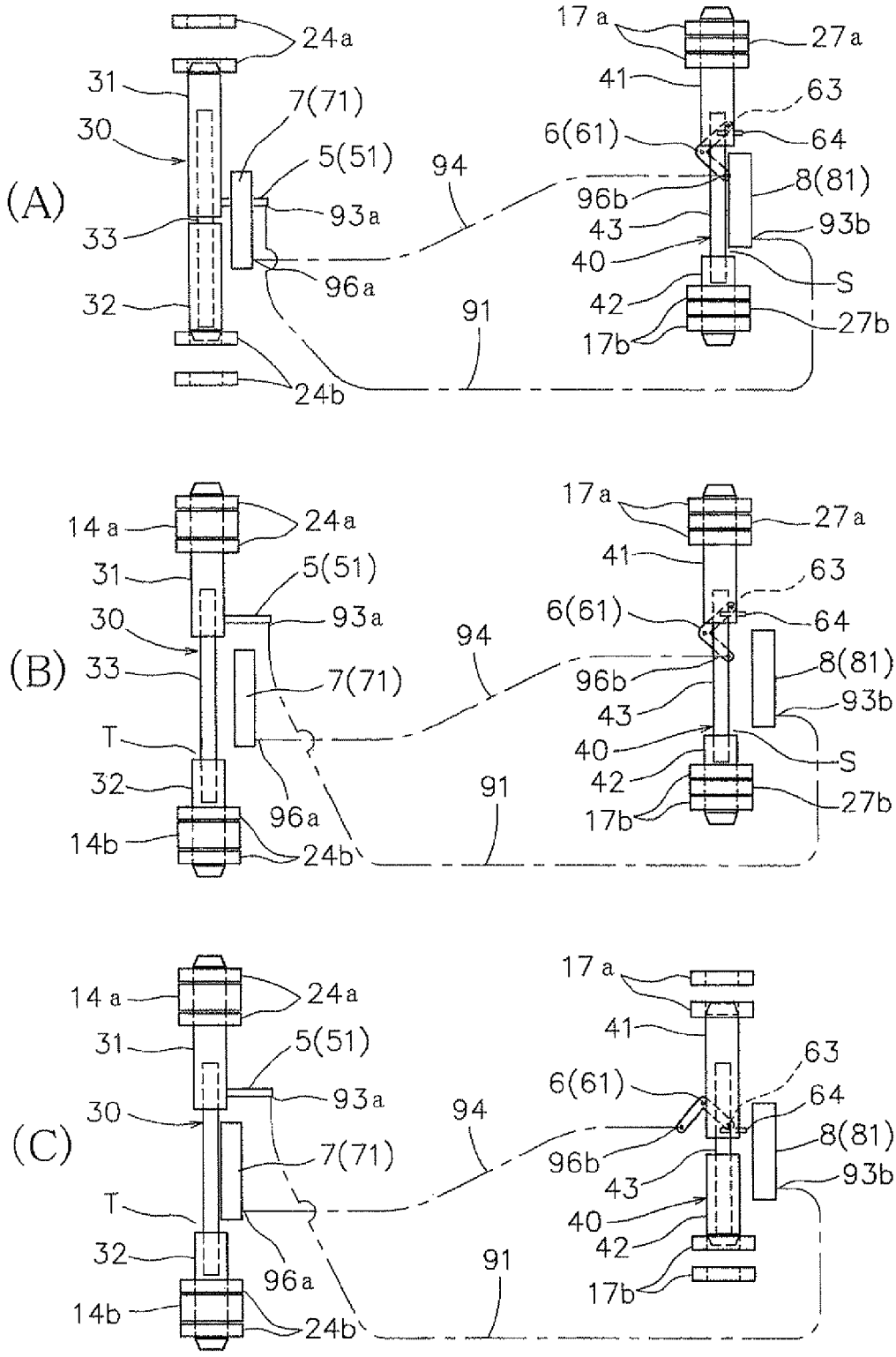
FIG. 11 is a view explaining the function of the jib stowing device according to the embodiment of the present invention.
Figure 12:
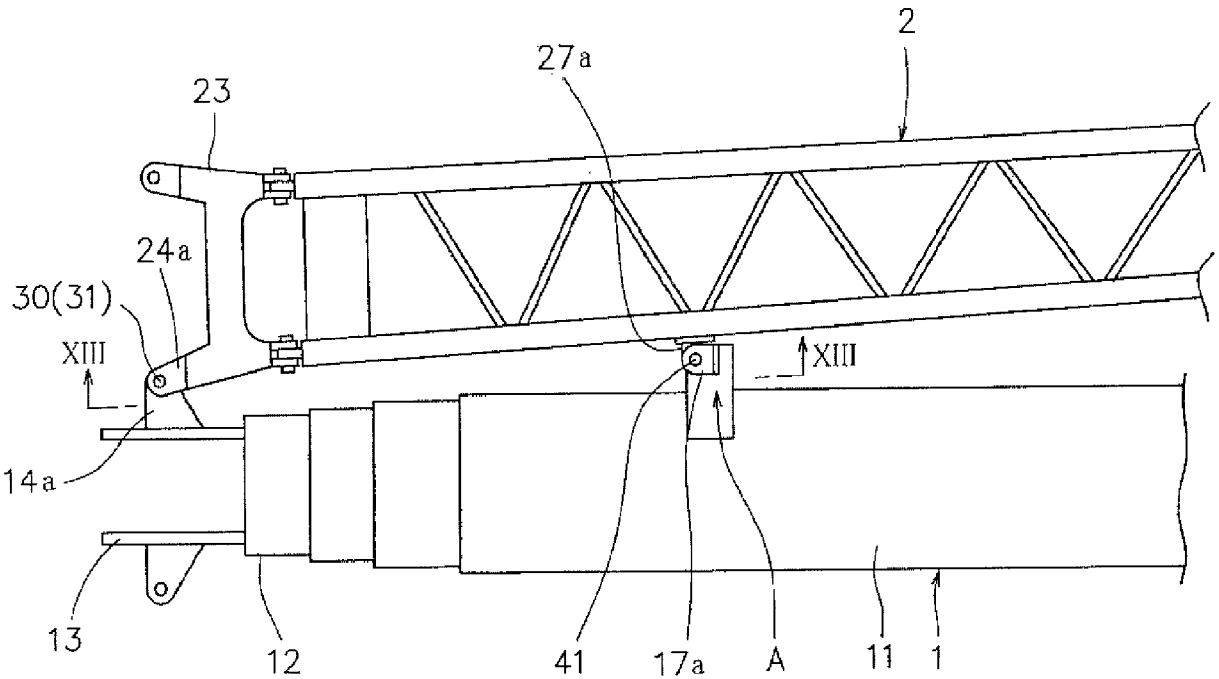
FIG.12 Prior Art
FIG. 12 is a partial plan view illustrating a jib stowage state of a jib crane vehicle according to a related art.
Figure 13:
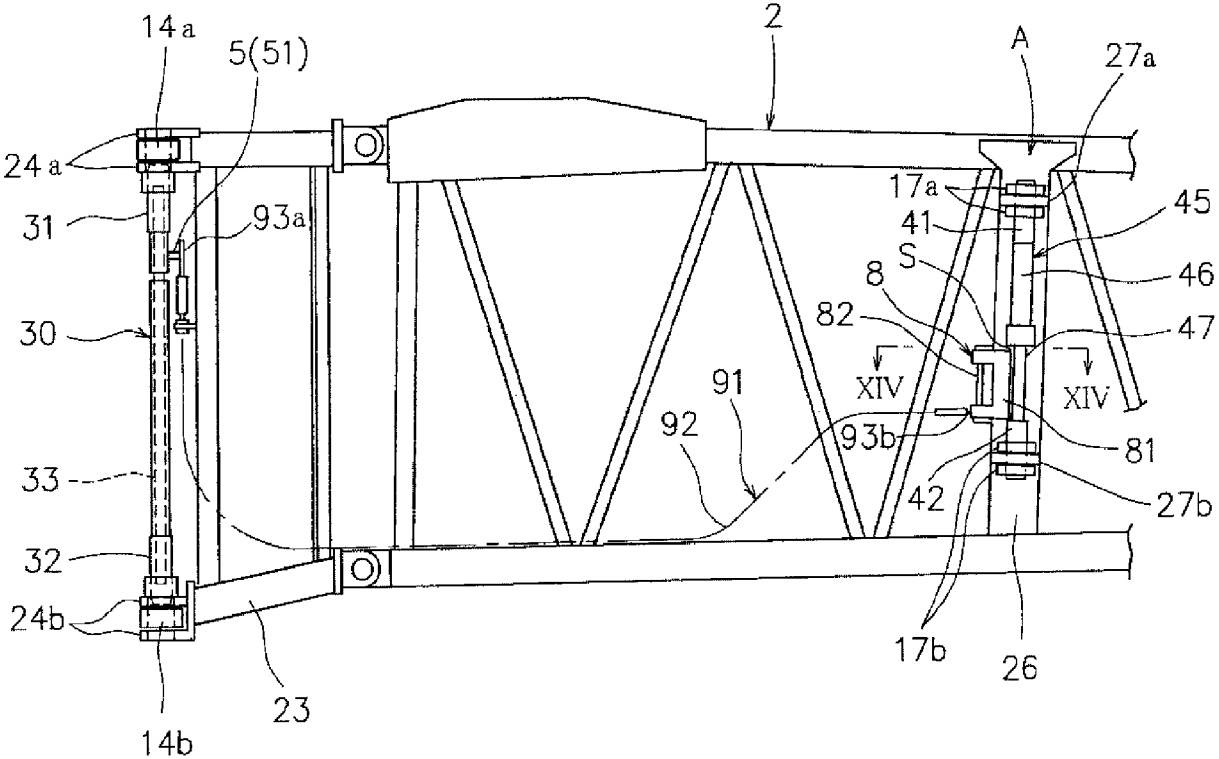
FIG.13 Prior Art
FIG. 13 is a cross-sectional view taken along the line XIII-XIII of FIG. 12.
Figure 14:
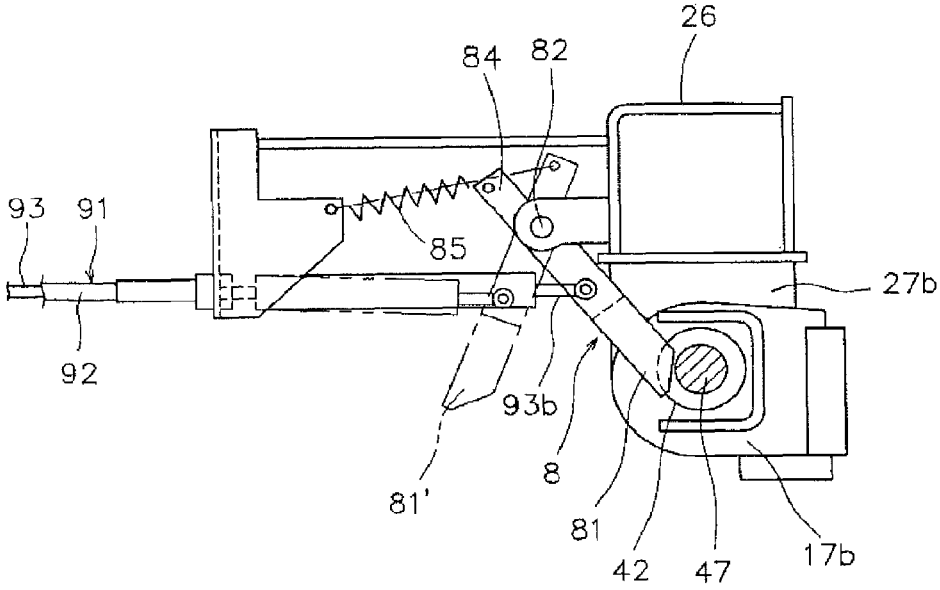
FIG.14 Prior Art
FIG. 14 is a cross-sectional view taken along the line XIV-XIV of FIG. 13.
Figure 15:
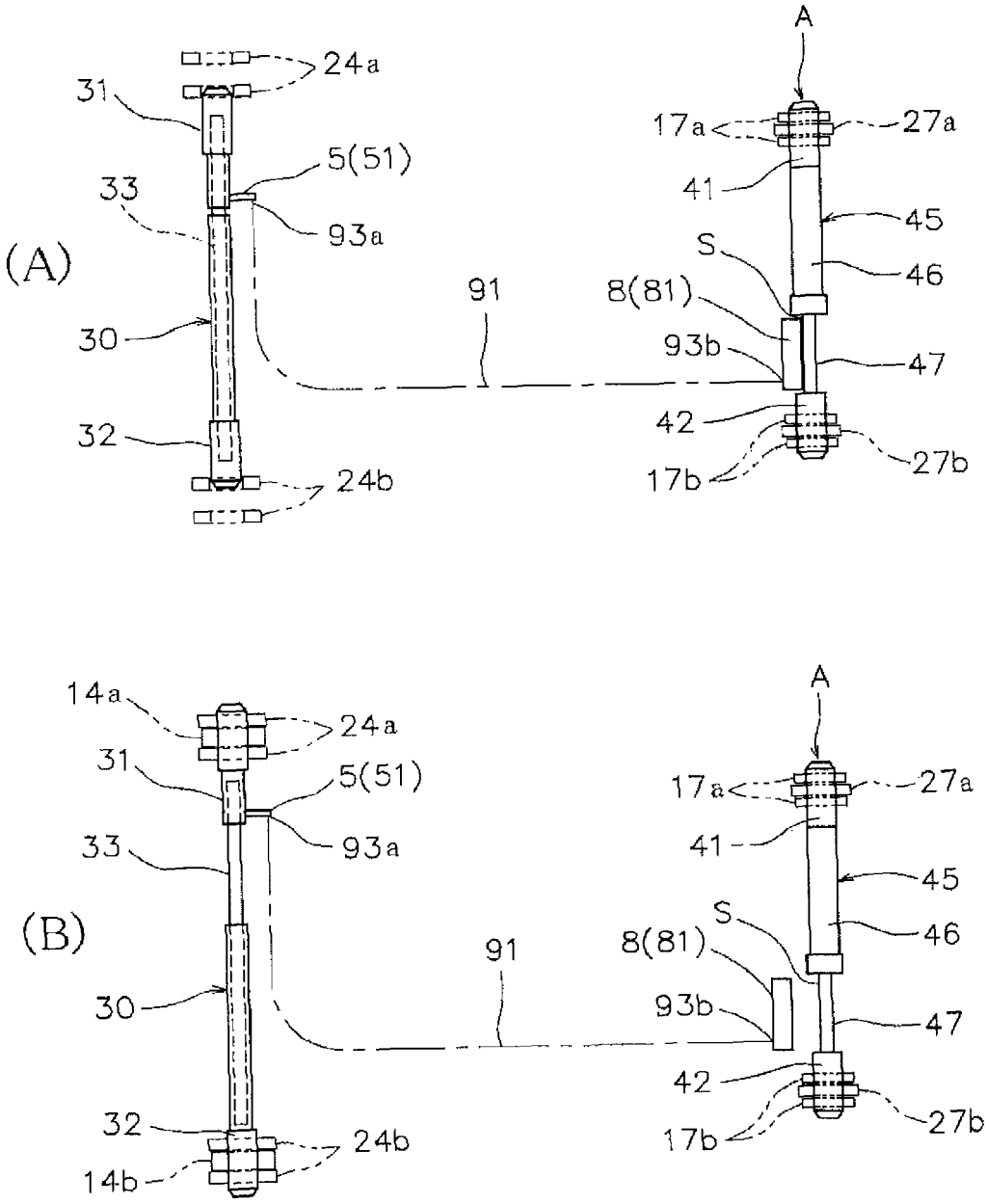
FIG.15 Prior Art
FIG. 15 is a view for explaining the function of a jib stowing device according to the related art.

1: telescopic boom
2: jib
5: pivot pin insertion state detecting means
6: coupling pin insertion state detecting means
7: pivot pin retraction restricting means
8: coupling pin retraction restricting means
11: base boom
12: top boom
13: top boom distal portion
14*a*, 14*b*: boss on top boom distal portion
17*a*, 17*b*: boss on base boom at first stowing means
21: base jib
23: jib proximal portion (jib support)
24*a*, 24*b*: boss on jib proximal portion
27*a*, 27*b*: boss on jib at first stowing means
30: pivot pin
31: upper pivot pin
32: lower pivot pin
33: threaded rod
40: coupling pin
41: upper coupling pin
42: lower coupling pin
43: threaded rod
51: protrusion
61: L-shaped lever
71: restricting member of pivot pin retraction restricting means
81: restricting member of coupling pin retraction restricting means
91: first associating means (control cable)
94: second associating means (control cable)
A: first stowing means
B: second stowing means

The invention claimed is:

1. A jib stowing device for a jib crane vehicle, comprising a jib removably attachable to a distal portion of a top boom of a telescopic boom mounted on a vehicle body, a common pivot pin retractably insertable into a top boom boss provided on a side portion of the distal portion of the top boom and a first jib boss provided on a side portion of a proximal portion of the jib when the bosses are aligned with each other so that the jib can be rotated about the pivot pin in a space on one side of the telescopic boom, with the telescopic boom being in a fully contracted state, between an extended position in which the jib is extended to the front of the distal portion of the top boom and a stowage position in which the jib is located along one side of a base boom of the telescopic boom, and stowing means provided between the base boom and the jib for stowing the jib on a lateral side of the base boom, wherein the stowing means has a base boom boss provided on the lateral side of the base boom, a second jib boss provided on a lateral side of the jib, and a coupling pin removably insertable into the base boom boss and the second jib boss, wherein the jib is provided with pivot pin insertion state detecting means for mechanically detecting whether or not the pivot pin is in an inserted position, pivot pin retraction restricting means for mechanically restricting movement of the pivot pin to a retracted side, coupling pin insertion state detecting means for mechanically detecting whether or not the coupling pin is in an inserted position, coupling pin retraction restricting means for mechanically restricting movement of the coupling pin to a retracted side, first associating means for mechanically associating the pivot pin insertion state detecting means and the coupling pin retraction restricting means, and second associating means for mechanically associating the coupling pin insertion state detecting means and the pivot pin retraction restricting means, wherein movement of the coupling pin to the retracted side is restricted by the coupling pin retraction restricting means via the first associating means when the pivot pin insertion state detecting means has detected a retracted state of the pivot pin, and the restriction of movement of the coupling pin to the retracted side by the coupling pin retraction restricting means via the first associating means is released when the pivot pin insertion state detecting means has detected an inserted state of the pivot pin, wherein movement of the pivot pin to the retracted side is restricted by the pivot pin retraction restricting means via the second associating means when the coupling pin insertion state detecting means has detected a retracted state of the coupling pin, and the restriction of movement of the pivot pin to the retracted side by the pivot pin retraction restricting means via the second associating means is released when the coupling pin insertion state detecting means has detected an inserted state of the coupling pin, wherein the coupling pin of the stowing means is provided on the base boom, and the coupling pin insertion state detecting means on the jib is removably engageable with the coupling pin, and wherein the coupling pin insertion state detecting means is engaged with the coupling pin when the jib is stowed on one side of the base boom so that the coupling pin insertion state detecting means can detect whether or not the coupling pin is inserted into the base boom boss and the second jib boss.

2. The jib stowing device for the jib crane vehicle according to claim 1 wherein the coupling pin insertion state detecting means comprises:

an L-shaped lever which is mounted on a shaft fixed to the jib and which has first and second lever ends on opposing sides of the shaft, wherein the lever pivots about the shaft for swinging movement between a stowage position where a protrusion on the first lever end is engaged with a push plate on the coupling pin and a disengaged position where the protrusion and push plate are disengaged, wherein the second lever end is fixed to a cable end of a cable serving as the first associating means, and wherein the L-shaped lever is separated from the push plate when the jib is separated from the base boom.

3. The jib stowing device for the jib crane vehicle according to claim 1, wherein the pivot pin is provided on the jib.

* * * * *